US011437210B2

(12) United States Patent
Lell

(10) Patent No.: US 11,437,210 B2
(45) Date of Patent: Sep. 6, 2022

(54) ELECTRIC INTERRUPTION SWITCH COMPRISING REACTIVE COATING IN THE REACTION CHAMBER

(71) Applicant: Peter Lell, Moosburg (DE)

(72) Inventor: Peter Lell, Moosburg (DE)

( * ) Notice: Subject to any disclaimer, the term of this patent is extended or adjusted under 35 U.S.C. 154(b) by 0 days.

(21) Appl. No.: 16/960,625

(22) PCT Filed: Jan. 8, 2019

(86) PCT No.: PCT/DE2019/100010
§ 371 (c)(1),
(2) Date: Sep. 30, 2020

(87) PCT Pub. No.: WO2019/137579
PCT Pub. Date: Jul. 18, 2019

(65) Prior Publication Data

US 2021/0012986 A1 Jan. 14, 2021

(30) Foreign Application Priority Data

Jan. 12, 2018 (DE) ..... 102018100686.1

(51) Int. Cl.
*H01H 33/02* (2006.01)
*H01H 39/00* (2006.01)

(52) U.S. Cl.
CPC ..... *H01H 39/006* (2013.01); *H01H 33/021* (2013.01); *H01H 2039/008* (2013.01)

(58) Field of Classification Search
CPC ..... H01H 39/006; H01H 39/002; H01H 2039/008; H01H 33/021; H01H 33/76; H01H 9/302; H01H 33/75; H01B 3/38
(Continued)

(56) References Cited

U.S. PATENT DOCUMENTS 3,797,978 A * 3/1974 Young ..... B22F 9/10 425/8
4,371,588 A * 2/1983 Kyle ..... C03C 27/02 174/151

(Continued)

FOREIGN PATENT DOCUMENTS

DE 1094336 B 12/1960
DE 69507907 T2 9/1999

(Continued)

OTHER PUBLICATIONS

International Search Report, dated Apr. 30, 2019, in corresponding PCT Application No. PCT/DE/2019/100010, Filed Jan. 8, 2019, Entitled "Electric Interruption Switch Comprising Reactive Coating in the Reaction Chamber".

*Primary Examiner* — William A Bolton
(74) *Attorney, Agent, or Firm* — Perry + Currier, Inc.

(57) ABSTRACT

An interruption switch is provided for interrupting high currents at high voltages, with a casing, which surrounds a contact unit defining the current path through the interruption switch which has a first and second connection contact and a separation region. The contact unit is formed such that a current can be supplied to it via the first connection contact and can be discharged therefrom via the second connection contact, or vice versa. The separation region is formed such that, when it is separated, the current path between the first connection contact and the second connection contact is interrupted. The separation region is arranged inside a reaction chamber. A coating with a reactive material is present in the reaction chamber. The reactive material is designed such that under the influence of an electric arc it attenuates or extinguishes the electric arc.

13 Claims, 5 Drawing Sheets

(58) Field of Classification Search
USPC ..... 200/61.08, 150 R
See application file for complete search history.

(56) References Cited

U.S. PATENT DOCUMENTS

| | | | | |
|---|---|---|---|---|
| 5,793,275 | A * | 8/1998 | Iversen | H01H 85/055 337/273 |
| 6,194,988 | B1 * | 2/2001 | Yamaguchi | H01H 39/006 180/279 |
| 8,716,615 | B2 * | 5/2014 | Fukuyama | H01H 39/006 200/61.08 |
| 2013/0175144 | A1 * | 7/2013 | Sprenger | H01H 39/006 200/61.08 |
| 2017/0211180 | A1 * | 7/2017 | Vezza | C23C 16/46 |
| 2017/0213676 | A1 * | 7/2017 | Lell | H01H 39/006 |
| 2017/0309432 | A1 * | 10/2017 | Lell | H01H 33/36 |

FOREIGN PATENT DOCUMENTS

| | | | |
|---|---|---|---|
| DE | 102014107853 | A1 | 7/2014 |
| GB | 467496 | A | 6/1937 |

* cited by examiner

ELECTRIC INTERRUPTION SWITCH COMPRISING REACTIVE COATING IN THE REACTION CHAMBER

The invention relates to an electrical interruption switch, in particular for interrupting high currents at high voltages.

Such switches are used for example in power plant and motor vehicle technology, and also in general mechanical and electrical engineering in electric switchboards of machines and plants, as well as within the framework of electromobility in electric and hybrid vehicles, but also in electrically operated helicopters and aircraft, for the defined and fast disconnection of high-current electrical circuits in case of an emergency. It is required of such a switch that its tripping and interruption function must still be reliably guaranteed even without maintenance after up to 20 years. Furthermore, such a switch must not give rise to any additional potential danger due to hot gas, particles, ejected fragments or leaking plasma.

One possible area of application in motor vehicle technology is the defined, irreversible disconnection of the on-board wiring from the car battery or drive battery shortly after an accident or generally after a short-circuiting operation in the on-board wiring caused in another way, for example by a defective power train or a defective electric motor, in order to avoid ignition sources through sparks and plasma which occur for example if cable insulations have been abraded by body sheet metal penetrating during the accident or if loose cable ends press against one another or against sheet-metal parts and abrade. If gasoline leaks at the same time in the case of an accident, such ignition sources can ignite inflammable gasoline-air mixtures which accumulate under the engine hood, for example.

Further areas of application are the electrical disconnection of an assembly from the on-board electrical system in the event of a short circuit in the assembly concerned, for example in an independent electric heating system or in an electric brake, as well as the emergency shutoff of a lithium battery, such as are used today in electric and hybrid vehicles, as well as in aircraft. These batteries, with a small overall installed size, have a high terminal voltage of up to 1200 V with extremely low internal resistance. Both of these can potentially result in a short-circuit current of up to 5000 A, in some cases and briefly even up to 30 kA, without the source voltage dropping significantly, which even after a few seconds can lead to the battery igniting or exploding. The interruption switch presented here is also highly suitable for the emergency shutoff of individual solar cell modules or entire solar cell arrays should it be necessary, because it can be designed triggerable or remote-controllable. Furthermore, it can also be designed such that, in addition or instead, it trips passively, thus it can also simultaneously take on the function of a conventional safety fuse.

All use cases mentioned here as a rule involve shutting off direct current, which, unlike alternating current, has no zero crossing. This means that an electric arc, once formed in or on the switch, is not extinguished by itself, but rather remains stable and vaporizes all the materials in its reach here due to its extremely high temperature of several 1000° C., and also produces highly toxic gaseous substances in addition to its extreme thermal action and emitted radiation energy. Furthermore, because of the high temperature of the electric arc, conductive substances, which support the electric arc and make it difficult to suppress it, often form from the materials of the switches thus surrounding it.

It is disproportionately more difficult to disconnect high-voltage direct currents than to disconnect or shut off high-voltage alternating currents and even more difficult the higher the lead inductance and the lower the effective resistance at the moment of the disconnection operation of the electric circuit.

Currently known high-current safety fuses have the disadvantage of a shutoff time that varies within a large range after the threshold amperage of the fuse has been reached. A cable protected in this way can therefore only be utilized to a very small proportion, e.g. 30%, of its current-carrying capacity, as otherwise a cable fire, for example, can occur in the event of an overload.

Starting from this state of the art, the object of the invention is to create an interruption switch, in particular for interrupting high currents at high voltages, in which the shutting off of high currents at high voltages can be achieved rapidly and effectively. In addition, a switch is to be created which is largely non-hazardous in terms of safety and can be produced in a simple and cost-effective manner. Furthermore, it is desirable to minimize the negative effects of the electric arc on the material which forms the interruption switch.

The invention achieves this object as described herein.

The interruption switch according to the invention has a casing, which surrounds a contact unit defining the current path through the interruption switch. The contact unit has a first and second connection contact and a separation region. The contact unit is formed such that a current can be supplied to it via the first connection contact and can be discharged therefrom via the second connection contact, or vice versa. The separation region is formed such that, when it is separated, the current path between the first connection contact and the second connection contact is interrupted. The separation region is arranged inside a reaction chamber, or the reaction chamber is defined in that the separation region of the interruption switch is present therein. A coating with a reactive material is present in the reaction chamber, wherein the reactive material is designed such that under the influence of an electric arc it attenuates or extinguishes the electric arc.

The presence of the coating with the reactive material has the advantage that an electric arc forming between the two separated parts of the separation region is extinguished more rapidly and more effectively.

The contact unit comprises the first and the second connection contact as well as the separation region, which separates the current path across the contact unit when the interruption switch according to the invention is switched. The separation region can be designed in any form, such as described for example in DE 10 2014 107 853 A1, DE 10 2014 110 825 A1, DE 20 2015 100 525 U1, DE 10 2015 112 141 A1, DE 10 2015 114 279 A1, DE 10 2015 114 894 A1, DE 10 2016 124 176 A1 and DE 10 2017 123 021 A1. Thus, for example, the separation region can be formed as a solid switch bar, which is formed for example as a simple rod or as a cylindrical or hollow prismatic tube, which is ruptured and thereby separated into at least two parts. However, the rod or the tube can also be merely shifted, with the result that a separation of the two connection contacts results. Alternatively, the separation region can also be designed such that a bolt is connected to two guide contacts, and the bolt is separated from one or two of the guide contacts when it is moved. Furthermore, the separation region can, however, also be a wire or a belt. The separation region is connected to both connection contacts. The separation region can be connected to the connection contacts directly or connected thereto via further conductive elements. When the interruption switch according to the invention is switched, i.e. when the current path is interrupted, the separation region is separated in such a way that the electrical connection between the two connection contacts is thereby interrupted. The separation of the separation region can be effected in any conceivable manner. In other words, the interruption switch according to the invention is one in which the separation region is separated by bursting or breaking open, i.e. the separation region is preferably designed in one piece before the separation. The separation region can be separated by active tripping, but also by passive tripping, of the interruption switch according to the invention.

The interruption switch according to the invention is preferably a consumable, which can be used only once to interrupt the current path. In other words, the interruption switch according to the invention is a single-use switch.

The passive tripping can be effected e.g. by melting of the material forming the separation region, for example when a particular threshold amperage is reached. Devices can also be attached to one or both separated parts of the separation region, which move these two ends further away from each other, e.g. through an existing tensile loading which can act after separation of the separation region. By way of example, a tensile loading by a prestressed spring may be mentioned here.

By active tripping of the interruption switch according to the invention is meant any type of mechanical or pyrotechnic energy which can separate the separation region. Thus, for example, the separation region can be separated by a pulling or pushing movement operating. Otherwise, a pyrotechnic material, such as for example an igniter (EED) or a mini detonator, is used, which is either located in the reaction chamber or else attached outside the reaction chamber such that it can act on the separation region through a pulling or pushing movement or a shock wave, and causes the separation thereof.

By a reaction chamber is meant a chamber inside the casing of the interruption switch according to the invention, in which the separation region is arranged, and in which the separated parts of the separation region are located after the separation thereof. As one of the separated parts of the separation region is connected to the first connection contact and a further part is connected to the second connection contact, an electric arc can occur between these two parts of the separation region when a high voltage is applied. In other words, the reaction chamber is also defined as the chamber in which an electric arc can form between the two parts of the separation region which are connected to the two connection contacts, i.e. the reaction chamber is an electric arc chamber. If there is additionally a pyrotechnic material in this chamber for active separation of the separation region, the reaction chamber can also be called a combustion chamber. The reaction chamber can be present as a separate chamber inside the casing of the interruption switch according to the invention. However, it can also be the case that the casing of the interruption switch according to the invention itself defines the external dimensions of the reaction chamber. The reaction chamber is preferably a chamber or space that is closed on all sides, in which no mass transfer with the surroundings can take place. Thereby, when the reactive material is vaporized, a pressure can be built up inside the reaction chamber, which additionally contributes to the extinction of the electric arc.

The first and second connection contacts are preferably contacts made of very electrically conductive material, which make a connection to a current path outside the casing of the interruption switch according to the invention possible, i.e. they are preferably located at least in part outside the interruption switch.

The coating with the reactive material is present in the reaction chamber, wherein the reactive material is designed such that under the influence of an electric arc it attenuates or extinguishes the electric arc, or under the influence of an electric arc it reacts in such a way that it attenuates or extinguishes the electric arc. The coating can be present entirely or partially on the inner surface of the reaction chamber. Alternatively or additionally, the coating can also be applied to the surface of the separation region. The whole inner surface of the reaction chamber is preferably provided with the coating.

In an embodiment of the interruption switch according to the invention, the reactive material can be designed such that under the influence of an electric arc it reacts in such a way that it absorbs energy from the electric arc. In other words, the reactive material is a material which enters an endothermic reaction under the influence of an electric arc. In this way, energy can be removed from the electric arc, whereby an attenuation or extinction of the electric arc occurs.

In an embodiment of the interruption switch according to the invention, the reactive material can be designed such that under the influence of an electric arc it is converted to a non-conductive substance or to non-conductive substances, i.e. the reactive material reacts under the influence of an electric arc to form a reaction product or reaction products which are not conductive. In this way, these reaction products cannot contribute to a strengthening of the electric arc, or attenuate or extinguish the electric arc after they have formed.

By non-conductive substances or non-conductive reaction products is meant according to the invention those which still have an insulation resistance between the connection contacts after the separation of greater than 1 MOhm at a test voltage of from 100 VDC.

In an embodiment of the interruption switch according to the invention, the reactive material can be designed such that under the influence of an electric arc it is vaporized, wherein—if it is present in the reaction chamber—it can react suitably with an extinguishing fluid. This is also to include the fact that reaction products forming from the reactive material are present in gaseous form due to the influence of an electric arc. In this way, the reactive material or its reaction products are located in the reaction chamber in the gaseous state. These can then influence the electric arc in the way of attenuation or extinction.

In an embodiment of the interruption switch according to the invention, the reactive material can also be designed such that under the influence of an electric arc it is decomposed into reaction products which can themselves then enter an exothermic reaction thereafter.

The contact unit can consist of an electrically conductive material, preferably copper or aluminum or brass, wherein copper or aluminum is preferred. When interruption switches according to the invention are used to disconnect high voltages at high currents, copper is preferably used. It remains to be noted that the separation effect can, however, be improved in particular in the case of small currents to be disconnected at high voltages through the use of aluminum, as here too an additional energy input is demonstrably achieved through the co-combustion of a larger or smaller mass of aluminum. This has the following advantages: The aluminum particles become smaller or disappear or vaporize. Due to the energy being generated during the co-combustion, there will be less dependence on the cooperation of the evaporation, caused by the electric arc, of any extinguishing agent present in the reaction chamber, i.e. even in the case of the input of small to medium-sized currents, flowing at the moment when the separation begins, a desired gas pressure can nevertheless be generated with it. Moreover, the separation region is anodizable, and thus an additional guarantee of high to very high insulation resistances after the interruption switch has been tripped, even if a possibly present extinguishing agent becomes more conductive due to the presence of aluminum particles.

In order to prevent aging processes for the contact material, and also always to ensure good contact resistances between the electric circuit to be disconnected and the separation element, as a rule all surfaces in contact with each other will additionally be provided with a very conductive coat. As a rule, this will be nickel, but in special cases the use of silver is also appropriate.

All named designs of the reactive material can also be present in combination. A reactive material which is designed such that under the influence of an electric arc it enters a reaction to form one or more non-conductive substances or reaction products which are present in gaseous form in the chamber is thus particularly preferred as reactive material.

The coating with the reactive material can furthermore bring with it the advantage that an undesired vaporization of components of the interruption switch due to the influence of an electric arc inside the reaction chamber to form very electrically conductive substances is prevented, or the gas being generated thereby is mixed with the gas being generated by vaporization or reaction of the reactive material. Furthermore, the reactive material can be designed such that it prevents the entry of an electric arc into the surface of the reaction chamber, or makes it difficult, through its mere presence or a counter reaction. Furthermore, the reactive material can be designed or act such that it splits an electric arc, once formed, into several branches, in order to limit or decrease the effect of the influence of the electric arc on the medium or the possible filling of the reaction chamber with an extinguishing agent, through which it flows. In addition, it is advantageous if the reactive material is designed such that it converts the energy introduced into the volume of the reaction chamber by the electric arc into other forms of energy such as light, heat, heating, vaporization or decomposition.

The reactive material is preferably an inorganic or ceramic material or glass, more preferably an inorganic or ceramic material. Examples of ceramic materials and glass are materials based on $SiO_2$, silanes or polysiloxanes, wherein polysiloxanes are preferred. These materials can contain further nanomaterials, which are emulsified therein. Examples of inorganic materials are permanganates, such as potassium permanganate, perchlorates, such as zirconium potassium perchlorate, or metal oxides, such as MgO or $MnO_2$. Furthermore, it is preferred for the reactive material not to contain any elements which are electrically conductive, or can be converted to electrically conductive elements through the influence of an electric arc. That is to say, the coating is preferably substantially free of carbon-containing materials and more preferably substantially free of organic materials. By "substantially free of carbon-containing materials or organic materials" is meant that they can be present in the coating in a maximum proportion of 1 wt.-%, and more preferably of 0.1 wt.-%. It is thus preferred that the coating preferably consists of the reactive material.

The inventor of the present invention assumes that, when $SiO_2$, silanes or polysiloxanes are used as reactive material, the latter is decomposed into Si and oxygen through the influence of an electric arc. The recombination of Si and oxygen to form $SiO_2$ is an exothermic reaction, which can release energy subsequent to the decomposition, which can be used to extinguish or attenuate the electric arc or simply only to vaporize the possibly present extinguishing agent and thus to positively support the separation effect. Through the decomposition of the $SiO_2$ electric arc energy is also stored temporarily, with the result that here the energy density of the electric arc and thus its harmful influence on the possibly present extinguishing agent or the adjoining surfaces in the reaction chamber can be clearly reduced.

In an embodiment of the interruption switch according to the invention, the reaction chamber can be filled with an extinguishing agent. The extinguishing agent can be a solid, powdery or liquid medium. The extinguishing agent is preferably a vaporizable medium. The extinguishing agent is preferably a liquid medium, which passes entirely or partially into a gaseous state when the boiling or vaporization temperature is reached. At the same time, it is preferred for the extinguishing agent also to have insulating properties, in order that the electric arc can be extinguished after the two separated parts of the separation region have been moved away from each other sufficiently and there is thereafter a sufficient insulation from a current flow, which is then undesired here, between the separated contacts. The extinguishing agent is preferably an oil, for example silicone oil, or a silane or polysiloxane, for example hexasilane or pentasilane with as little as possible carbon atom content.

In an embodiment of the interruption switch according to the invention, the reactive material is designed such that it partly withstands the high temperatures of the electric arc (after the drying of the reactive material, for example, a hard silicon dioxide layer forms on all surfaces of the reaction chamber coated with this material), and partly vaporizes under the influence of an electric arc, partially reacts with the extinguishing agent and thus also attenuates or extinguishes the electric arc.

In an embodiment of the interruption switch according to the invention, all surfaces of the reaction chamber are coated with the reactive material. However, it is preferred for the surface of the inner wall of the casing to be omitted in the coating with the reactive material, as it is preferred for the electric arc to be deflected towards this region. In other words, it is preferred for the outer surface of the separation region to be coated with the reactive material, and optionally the surface of the sabot which is located inside the reaction chamber.

If the reaction chamber contains an extinguishing agent, the coating of the reaction chamber has the advantage that, after the separation of the separation element, the originally very electrically non-conductive extinguishing agent located in the reaction chamber, strained by the electric arc, remains electrically non-conductive even after being strained or partially decomposed by the electric arc into its basic elements, the insulation resistance thus measurable between the connection contacts after the separation is so high that an appreciable current flow can no longer be effected in the case of the external voltage still being applied there after the separation. Otherwise, the extinguishing agent would be heated up and vaporized very rapidly due to the fault current then flowing here, whereby the internal pressure in the assembly can increase until the latter is broken or torn apart.

In an embodiment of the interruption switch according to the invention, the contact unit can have a sabot or be designed such that a part or a surface acts as a sabot, which is designed in such a way that it can be moved from a starting position into an end position by exposure to pressure, wherein in the end position of the sabot the separation region is separated and an insulation spacing between the first and the second connection contact is achieved. It is preferred here for the reactive material of the coating to be designed such that it vaporizes under the influence of an electric arc. This has the advantage that a gas pressure is generated in the reaction chamber, which can act on the sabot, which is thereby moved from the starting position into the end position. In addition, it is preferred, in this embodiment, for the reaction chamber to be filled with an extinguishing agent which represents a vaporizable medium. In this way, through a heating of the separation region or through the influence of an electric arc the medium can be vaporized and thus the gas pressure can be increased.

The coating with the reactive material in the reaction chamber is preferably effected by application of a liquid ceramic or a liquid glass, which is subsequently dried. The application of the liquid ceramic can be produced, for example, by spraying the liquid ceramic or by dip coating, in which the surface to be coated is dipped into the liquid ceramic, or simply only by spreading. For example, a liquid mixture of siloxanes and nanomaterials, such as is available on the market for example as "9H Auto Ceramic Coating", is referred to as so-called liquid ceramic.

The coating preferably has a thickness in the range of from 10 μm to 100 μm, more preferably in the range of from 20 μm to 50 μm.

In a further embodiment, the present invention also relates to the use of a reactive material to coat surfaces in a reaction chamber of an interruption switch, wherein the reactive material is designed such that under the influence of an electric arc it attenuates or extinguishes the electric arc, or under the influence of an electric arc it reacts in such a way that it attenuates or extinguishes the electric arc. The interruption switch in the use according to the invention is preferably the interruption switch according to the invention. Alternatively, the use according to the invention can also be formulated in the following way as a method: method for the production of a coating on surfaces in a reaction chamber of an interruption switch, wherein a reactive material is applied to the surfaces, wherein the reactive material is designed such that under the influence of an electric arc it attenuates or extinguishes the electric arc.

In a further embodiment of the use according to the invention, the reactive material can be applied to the surfaces as a liquid material and then dried. Preferably a liquid ceramic or a liquid glass is used as liquid material here. Possible procedures according to the invention are described further above.

Further aspects of the invention are provided herein. The features of the interruption switch according to the invention set out in the above-named embodiments can unless they are mutually exclusive be combined as desired according to the invention.

The invention is explained in more detail below with reference to the embodiments represented in the drawings. All features which are described in relation to a particular figure can also be transferred to the interruption switches of the other figures, if technically feasible:

Figure 1:
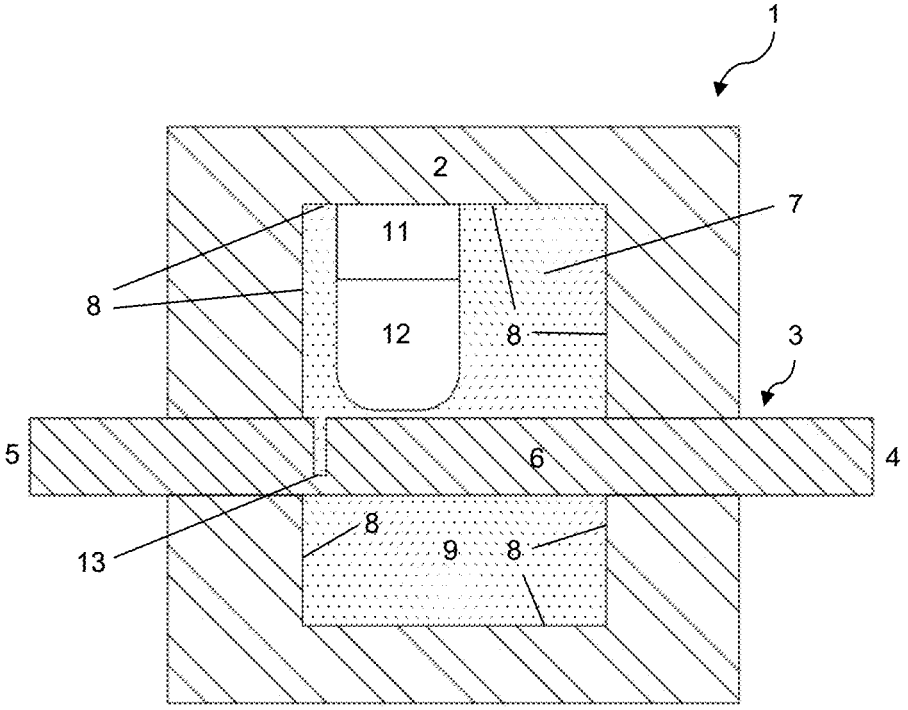
FIG. 1 shows a schematic view of an interruption switch according to the invention before the separation of the separation region.
Figure 2:
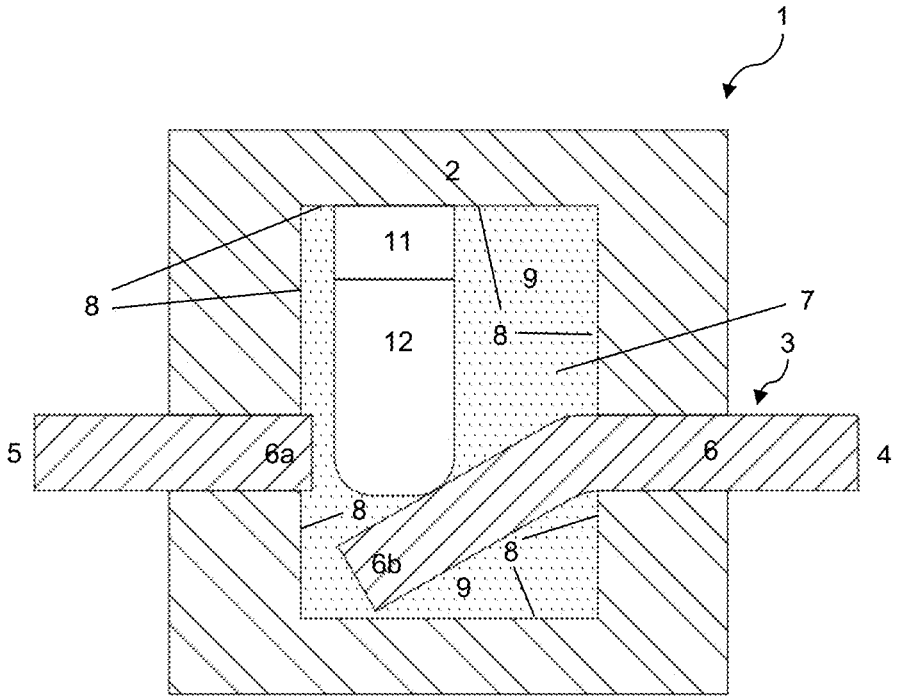
FIG. 2 shows a schematic view of the interruption switch according to the invention according to FIG. 1 after the separation of the separation region.

FIG. 1 and FIG. 2 show schematic views of an interruption switch 1 according to the invention before and after the separation of the separation region 6. The interruption switch 1 has a casing 2, through which the contact unit 3 passes. The contact unit 3 has a first connection contact 4 on one side and a second connection contact 5 on the other side, which are electrically connected to each other via the separation region 6 in the interruption switch 1 in FIG. 1. The separation region 6 runs through a reaction chamber 7, which is surrounded by the casing 2. As shown in FIG. 1, the separation region 6 can have one predetermined breaking point 13, but can have two or more predetermined breaking points. The reaction chamber 7 is preferably filled with an extinguishing agent 9. Furthermore, a drive 11 which is connected to a ram 12 is provided in the reaction chamber 7. The drive 11 can be designed for example as a pyrotechnic drive. If the drive 11 is actuated, the ram 12 applies pressure to the separation region 6 of the contact unit 3. In the process a separation of the separation region 6 occurs at the predetermined breaking point 13, whereby the first connection contact 4 and the second connection contact 5 are no longer connected. FIG. 1 shows the interruption switch 1 in the conductive position, whereas FIG. 2 shows the same interruption switch 1 after being switched into the non-conductive position, in which the separation region 6 is separated into the separated parts 6*a* and 6*b*. Furthermore, a coating 8 with the reactive material, which preferably extends completely over the inner wall of the reaction chamber 7, is provided in the interruption switch 1. Alternatively or additionally, a corresponding coating can be present on all surfaces of the further components inside the reaction chamber, such as for example the ram 12 or the drive 12.

Figure 3:
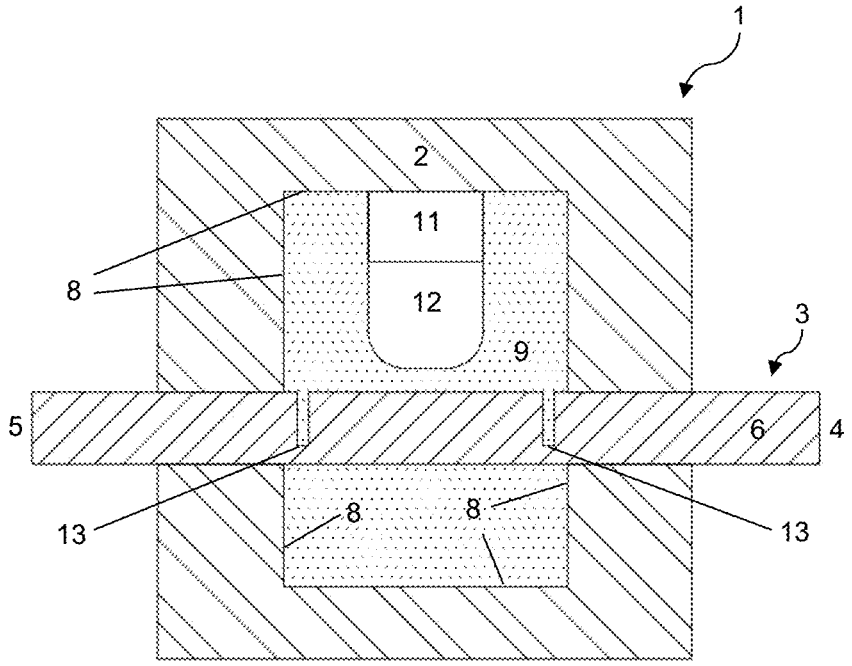
FIG. 3 shows a schematic view of an interruption switch according to the invention before the separation of the separation region, wherein the separation region has two possible predetermined breaking points.
Figure 4:
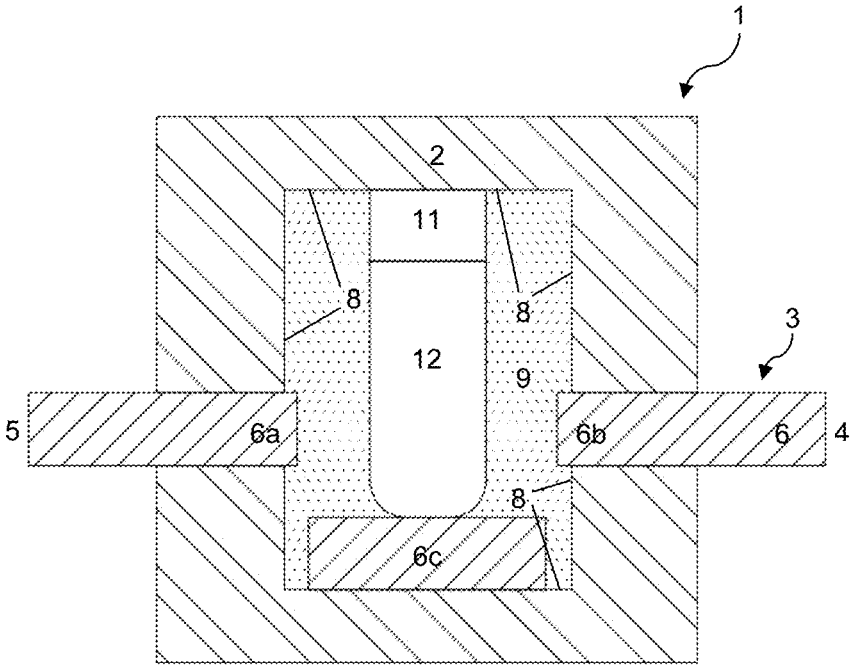
FIG. 4 shows a schematic view of the interruption switch according to the invention according to FIG. 3 after the separation of the separation region, with two separation points.

FIG. 3 and FIG. 4 likewise show schematic views of an interruption switch 1 according to the invention before and after the separation of the separation region 6. The interruption switch 1 in FIG. 3 and FIG. 4 is in principle constructed in a similar way to the interruption switch 1 in FIG. 1 and FIG. 2, with the difference that the separation region 6 has two predetermined breaking points 13, which are separated via the ram 12 when the drive 11 is actuated. FIG. 4 shows the interruption switch 1 in the so-called separation position, in which the separation region 6 is separated into three parts 6*a*, 6*b*, 6*c*. All named preferred features of the interruption switch of FIGS. 1 and 2 also apply to the interruption switch of FIGS. 3 and 4.

The oscillograms shown in FIGS. 5 to 8 contain the measurements of the ignition current for the pyrotechnic material formed as an EED, of the voltage of the discharging capacitor charged before the interruption switch is tripped, of the current to be separated over the two connection contacts and of the voltage over the two connection contacts separated after the pyrotechnic material has been triggered.

Figure 5:
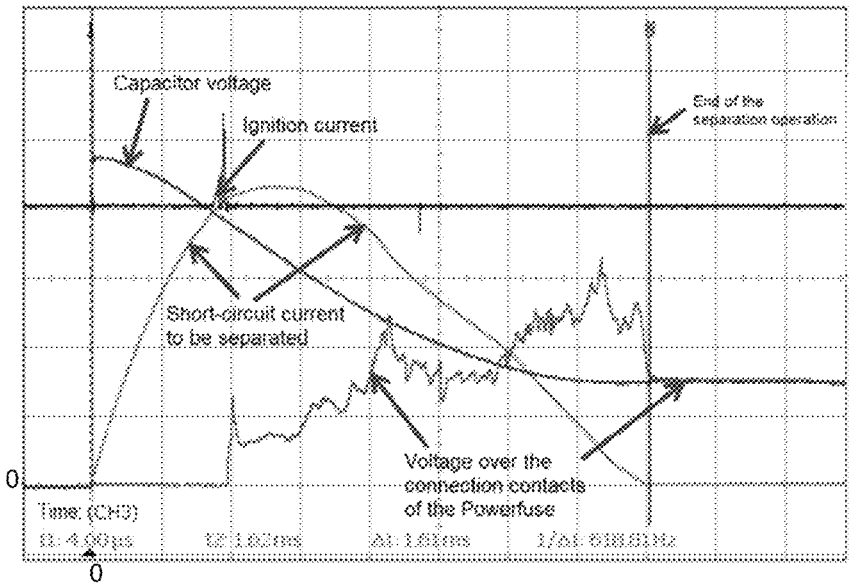
FIG. 5 shows an oscillogram of different measured currents and voltages in an interruption switch without coating according to the invention, in which the separation of the separation region has been effected by means of a pyrotechnic material (timescale: 200 μs/scale division).
Figure 6:
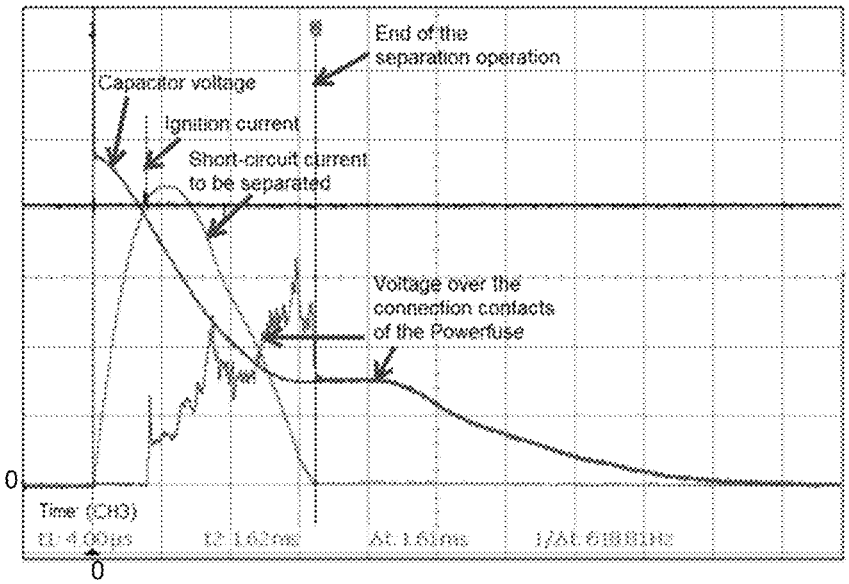
FIG. 6 shows an oscillogram as in FIG. 5 with a timescale of 500 μs/scale division.
Figure 7:
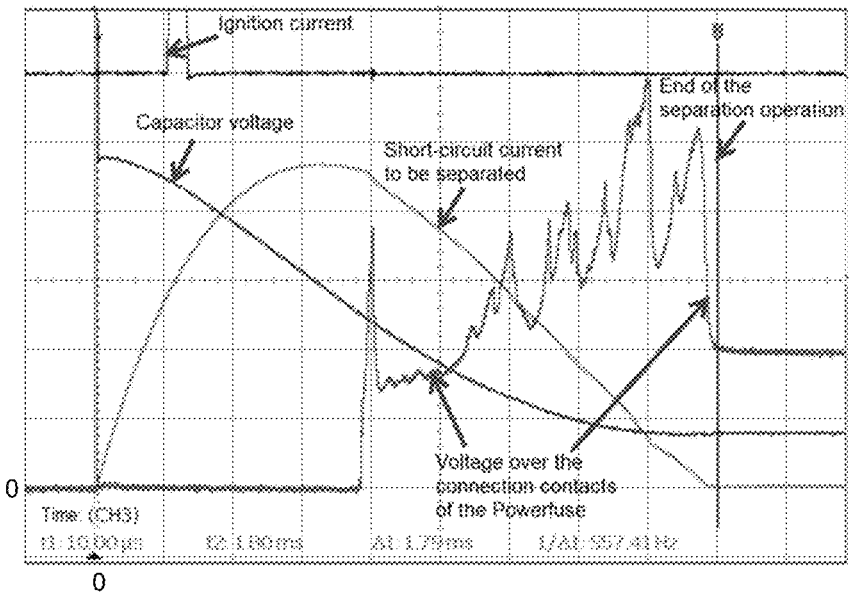
FIG. 7 shows an oscillogram of different measured currents and voltages in an interruption switch according to the invention, in which the surfaces of the reaction chamber were coated with a reactive material before the separation (timescale: 200 μs/scale division).
Figure 8:
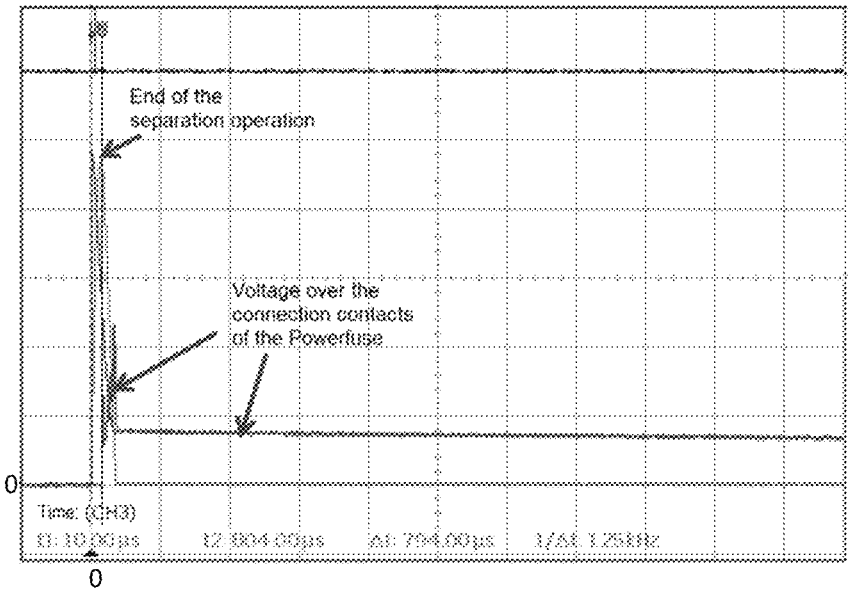
FIG. 8 shows an oscillogram as in FIG. 7 with a timescale of 5 ms/scale division.
Figure 9:
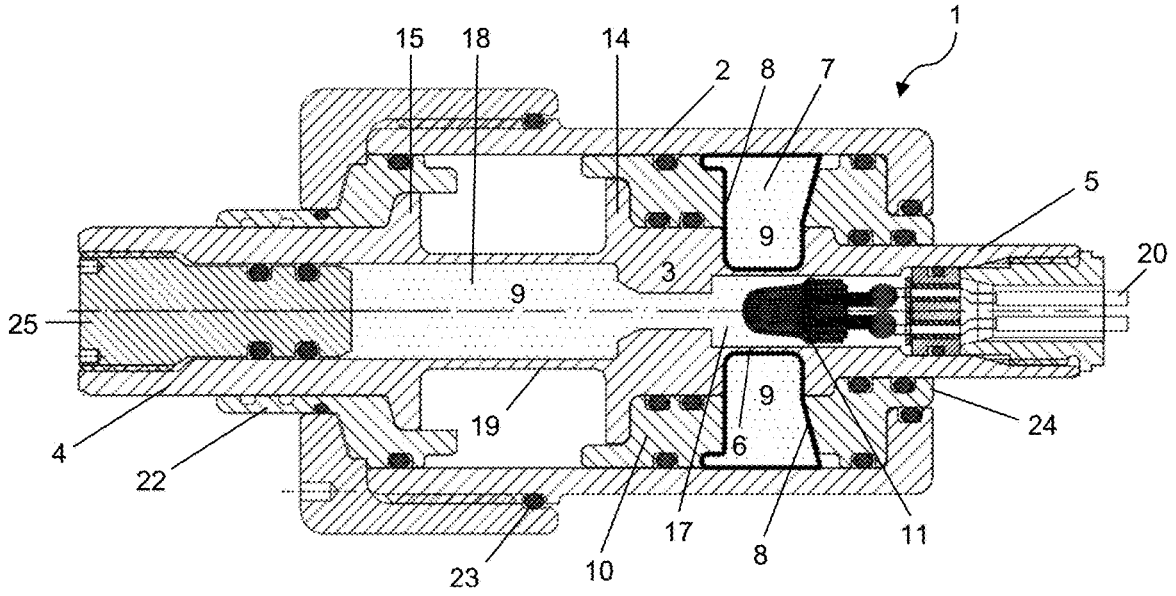
FIG. 9 shows a schematic view of an interruption switch used in the measurements of the oscillograms shown in FIGS. 7 and 8 before the separation of the separation region.

The oscillograms of FIGS. 7 and 8 show measurements with an interruption switch 1 with a coating 8 of a reactive material in the reaction chamber 7, as shown in FIG. 9 and described further below. The oscillograms of FIGS. 5 and 6 show measurements with an interruption switch, as shown in FIG. 9, with the only difference that here the inner wall of the reaction chamber 7 is not provided with a coating 8 of a reactive material. The x-axis defines the time in all oscillograms shown. The y-axis defines either the direct voltage or the direct current. The respective zero points are marked in the oscillograms. In FIGS. 5 and 7 one scale division (from one point to the next) defines a time span of 200 μs. FIG. 6 shows the same measurement as in FIG. 5, with the difference that one scale division defines a time span of 500 μs. FIG. 8 shows the same measurement as in FIG. 7, with the difference that one scale division defines a time span of 5 ms. With respect to the ignition current, one scale division (from one point to the next) in all of FIGS. 5 to 8 defines a current of 10 A. With respect to the capacitor voltage, one scale division in all of FIGS. 5 to 8 defines a voltage of 500 V. With respect to the short-circuit current to be separated, one scale division in all of FIGS. 5 to 8 defines a current of 2500 A. With respect to the voltage over the connection contacts of the interruption switch (denoted Powerfuse in the figures), one scale division in FIGS. 5, 6 and 8 defines a voltage of 500 V, and in FIG. 7 a voltage of 200 V.

As can be seen from the comparison of the oscillograms of the interruption switch 1 according to the invention with coating 8 (FIGS. 7 and 8) with the interruption switch not according to the invention without coating (FIGS. 5 and 6), in both interruption switches an excellent separation effect occurs, but only when an interruption switch according to the invention is used is a sufficiently good insulation obtained between the separated contacts after successful separation.

Thus, the measured voltage over the separated connection contacts 4 and 5 in FIG. 7 already begins to drop off after 500 μsec after successful separation, and thereafter down to 0 V, and the current still flowing here discharges the residual energy still present in the discharging capacitor, whereas that is not the case in FIG. 8, where this voltage is preserved.

The slight drop-off to be seen in FIG. 8 of the voltage over the connection contacts 4 and 5 of the interruption switch 1 after successful separation is effected via the discharge resistors of the discharge bank and not by the current flow (not present here) through the interruption switch 1.

The embodiment represented in FIG. 9 of an interruption switch 1 according to the invention comprises a casing 2, in which a contact unit 3 is arranged. The casing 2 is formed such that it withstands a pressure, generated inside the casing 2, which is generated for example in the case of a pyrotechnic tripping of the interruption switch 1, without there being the danger of damage or even bursting. The casing 2 can consist in particular of a suitable material, preferably steel. In the embodiment example represented, the contact unit 3 is formed as a switch tube that is depressed by the sabot 10 in the upsetting region, with the result that it is formed as a tube in the separation 6 and upsetting 19 regions. In the embodiment example represented, the contact unit 3 has a first connection contact 4 with a larger diameter and a second connection contact 5 with a smaller diameter. Adjoining the first connection contact 4 is a flange 15 extending radially outwards, which is braced on an annular insulator element 22, which consists of an insulating material, for example a plastic, in such a way that the contact unit 3 cannot be moved out of the casing 2 in the axial direction. For this purpose, the insulator element 22 has an annular shoulder, on which the flange 15 of the contact unit 3 is braced. In addition, the insulator element 22 insulates the casing 2 from the contact unit 3. The contact unit 3 has an upsetting region 19 adjoining the flange 15 in the axis of the contact unit 3. In the upsetting region 19, which has a predetermined axial extent, the wall thickness of the contact unit is chosen and matched to the material such that, when the interruption switch 1 is tripped as a result of a plastic deformation of the contact unit 3 in the upsetting region 19, the upsetting region is shortened in the axial direction by a predetermined distance.

Adjoining the upsetting region 19 in the axial direction of the contact unit is a flange 14, on which a sabot 10 sits in the embodiment example represented. The sabot 10, which consists of an insulating material, for example a suitable plastic, in the embodiment example represented, surrounds the contact unit 3 in such a way that an insulating region of the sabot 10 engages between the outer circumference of the flange 14 and the inner wall of the casing 2. If a pressure acts on the surface of the sabot 10, a force is generated which compresses the upsetting region 19 of the contact unit 3 via the flange 14. This force is chosen such that, during the tripping operation of the interruption switch 1, an upsetting of the upsetting region 19 occurs, wherein the sabot 10 is moved from its starting position (status before the interruption switch 1 is tripped) into an end position (after the switching operation has been completed).

As can be seen from FIG. 9, the sabot 10 can be chosen such that its external diameter substantially corresponds to the internal diameter of the casing 2, with the result that an axial guidance of the flange 14 and thus also an axially guided upsetting movement during the switching operation is achieved.

After the pressing operation the lugs of the insulator 22 and of the sabot 10 located close to the casing 2 overlap completely, with the result that the upsetting region 19 pushed together in a meandering fashion after the tripping and the upsetting operation is completely surrounded by electrically insulating materials.

Adjoining the sabot 10 or the flange 14 of the contact unit 3 is a separation region 6. The second connection contact 5 then adjoins this side of the contact unit 3. A closure 24 closes the casing 2.

In the embodiment example represented the sabot 10 is pushed onto the contact unit 3 from the side of the connection contact 5 during the assembly of the interruption switch 1. The closure 24 is designed as an annular component which has an external diameter which substantially corresponds to the internal diameter of the casing 2.

In the axial end of the contact unit 3 in the region of the second connection contact 5 a drive 11, preferably a pyrotechnic drive, is provided, here often also called a mini detonator or a priming screw. The electrical connection lines 20 of the drive 11 can be guided outwards through an opening in the annular closure 24.

The separation region 6 is dimensioned such that it tears open at least partially through the gas pressure generated or the shock wave generated by the drive 11, with the result that the pressure or the shock wave can also propagate out of the combustion chamber 17 into the reaction chamber 7 designed as a surrounding annular space. To facilitate the tearing open, the wall of the contact unit 3 in the separation region 6 can also have one or more openings or holes and/or grooves.

The drive 11 for igniting the pyrotechnic material (ignition device) can consist of a simple, rapidly heatable glow wire. The activation of the drive 11 can be effected by a corresponding electrical actuation. Of course, however, the drive 11 can also be formed in any other desired manner which brings about an activation of the pyrotechnic material, also in the form of a conventional igniter (EED), an ignition tablet, a squib or a mini detonator.

When the interruption switch 1 is activated by means of the drive 11, a pressure or a shock wave is thus generated on the side of the sabot 10 facing away from the upsetting region 19, whereby the sabot 10 is exposed to a corresponding axial force. This force is chosen through a suitable dimensioning of the pyrotechnic material such that in the upsetting region 19 the contact unit 3 is plastically deformed, torn open or caved in, and the sabot 10 is then moved in the direction of the first connection contact 4. The pyrotechnic material is dimensioned such that, after the separation region 6 has been broken open or caved in, the movement of the sabot 10 moves the two separation halves sufficiently far away from each other, in cooperation with the vaporization of the extinguishing agent 9 then even into an end position.

Directly after the pyrotechnic material has been activated, the separation region 6 is thus at least partially torn open or caved in. If the tearing open or caving in has not already been effected before the start of the axial movement of the sabot 10 over the entire circumference of the separation region 6, a residual remainder of the separation region 6, which causes another electrical contact, is completely torn open by the axial movement of the sabot 10, intensified by the very rapid heating then occurring here of the residual cross section of the conductor, which is then only small here, due to the electric current flowing here.

In particular, the gas pressure generated by the combustion or the shock wave generated can be controlled well by the introduction of easily gasifiable liquids or solids (extinguishing agent 9) into the space in which the pyrotechnic material is contained or into which the hot gases generated penetrate. Thus, in particular water, in solution with the extinguishing agent 9 or in the form of microcapsules, gels etc., increases the gas pressure considerably; an admixture of chemicals which also react when heated also makes sense, e.g. the addition of red phosphorus, but in particular also of particular combustible and ignition substances, such as zirconium potassium perchlorate (ZPP), but also of polysiloxanes such as hexasilane or pentasilane. An increase in the gas pressure brought about in such a way can turn out to be even more extreme if, for example, the water introduced into the combustion chamber 17 is superheated, in particular because the strongly heated water experiences an explosive decompression when the separation region 6 is broken open.

In the embodiment shown in FIG. 9, an extinguishing agent 9 which promotes the propagation of the shock wave when the pyrotechnic material is detonated or deflagrated is located in the combustion chamber 17 and in the reaction chamber 7, with the result that in this way less activatable material needs to be used and the walls of the separation region 6 can be kept sufficiently thick, with the result that the assembly can also be used even in the case of high operating currents. The extinguishing agent serves to attenuate or extinguish an electric arc between the separated ends of the separation region 6.

Furthermore, a coating with a reactive material is provided in the reaction chamber 7, preferably a layer of $SiO_2$ which covers the entire inner wall of the reaction chamber 7 and preferably has a layer thickness of 30 μm.

Furthermore, in the interruption switch 1 according to the invention of FIG. 9 a channel is provided which extends underneath the sabot 10, in particular in the flange 14, preferably centrally in the axial direction, and connects the combustion chamber 17 to an upsetting chamber 18 underneath the upsetting region 19. The contact unit 3 is thus further formed as a continuous switch tube in the embodiment example represented. In this embodiment, the combustion chamber 17, the channel, the reaction chamber 7 and the upsetting chamber 18 can all be filled with the extinguishing agent 9. The channel ensures that, in the case of the tripping of the interruption switch 1 and the movement of the sabot 10 associated therewith from the starting position into the end position, the increasing volume in the region of the combustion chamber 17 and the reaction chamber 7 is also refilled with extinguishing agent 9. Through the movement of the sabot 10 from the starting position into the end position, extinguishing agent 9 in the upsetting chamber 18 is compressed and injected through the channel in the direction of the region of the combustion chamber 17 and here directly onto the separation region 6. In this way, an electric arc between the separated parts of the separation region 6 can additionally be attenuated or extinguished.

The central channel can be narrowed in the manner of a nozzle before the combustion chamber 17 or before the separation region 6, in order firstly to allow extinguishing agent 9 to pass sufficiently well from the upsetting region 19 into the combustion chamber 17, secondly to weaken the shock wave generated by the mini detonator towards the upsetting region 19 such that the upsetting region is not too greatly damaged beforehand after the ignition of the mini detonator.

Furthermore, sealing elements 23 for sealing the different chambers 7, 17 and 18 against the escape of extinguishing agent 9 and for sealing the different components from each other are provided in the interruption switch 1.

The interruption switch 1 according to FIG. 9 is in principle constructed exactly like the interruption switch of DE 10 2016 124 176 A1 shown in FIG. 5.

Figure 10:
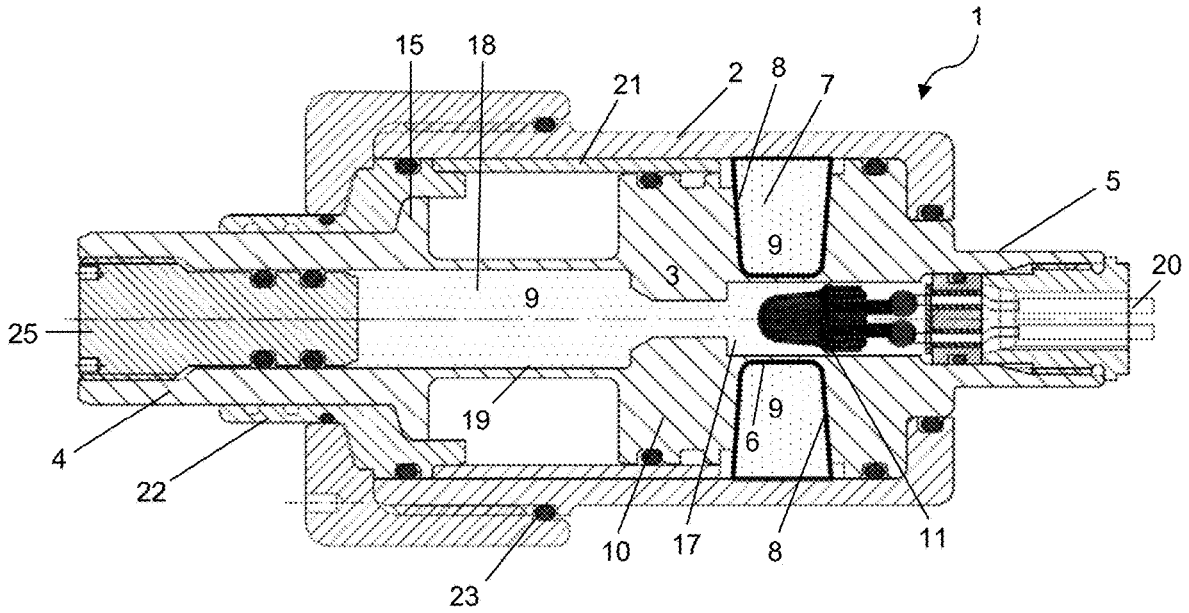
FIG. 10 shows a schematic view of an interruption switch, with an internal insulation layer on the inner wall of the reaction chamber instead of the sabot used in FIG. 9 made of insulating material, which has the same good separation properties with subsequent good insulation resistance between the separated contacts.

The interruption switch 1 of FIG. 10 is identical to the interruption switch of FIG. 9 except for the following changes:

Between the separation region 6 and the upsetting region 19 of the contact unit 3 the flange 14 shown in FIG. 9 is formed such that it reaches as far as an insulation layer 21 applied to the inside of the casing 2. The contact unit 3 itself thus has the sabot 10 or the function of a sabot 10. This has the advantage of saving material and simpler design of the interruption switch 1. The insulation layer 21 here creates an insulation between the contact unit 3 and the casing 2.

The contact unit 3 now also fulfills at the same time also the function of the closure, with the result that here a further component of the assembly is dispensed with, and in addition, during the production of the contact unit 3, either less machining or less forming is needed here, which further reduces the production costs.

The interruption switch used for the measurements of the oscillograms of FIGS. 5 to 8 has the dimensions shown in FIG. 9, wherein the length of the casing is 52 mm and the diameter of the casing is 30 mm. The casing is made of steel. The drive is a mini detonator with 30 mg silver azide and 40 mg RDX. The extinguishing agent is a mixture of silicone oil and highly dispersible silica (HDS) (40 cm3 oil to 2 g HDS). Polysiloxanes are the reactive material of the coating in the reaction chamber and the layer thickness is approximately 30 μm. The contact unit is shaped cylindrically and consists of copper. The separation region has an internal diameter of 6 mm and an external diameter of 7.2 mm. The complete length of the contact unit including the connection contacts is 85 mm.

LIST OF REFERENCE NUMBERS

1 interruption switch
2 casing
3 contact unit
4 first connection contact
5 second connection contact
6 separation region
6*a*, 6*b*, 6*c* separated parts of the separation region
7 reaction chamber
8 coating
9 extinguishing agent
10 sabot
11 drive
12 ram
13 predetermined breaking point
14 flange
15 flange
16 drive
17 combustion chamber
18 upsetting chamber
19 upsetting region
20 electrical connection lines
21 insulation layer
22 insulator element
23 sealing element (O-ring)
24 closure
25 closure element for upsetting chamber

The invention claimed is:

1. An interruption switch for interrupting high currents at high voltages, the interruption switch comprising:

a casing, which surrounds a contact unit defining a current path through the interruption switch, the contact unit comprising a first connection contact, a second connection contact and a separation region, wherein the contact unit is formed such that a current is supplied to the contact unit via the first connection contact and discharged therefrom via the second connection contact, or vice versa, wherein the separation region is formed such that, when separated, the current path between the first connection contact and the second connection contact is interrupted, wherein the separation region is arranged inside a reaction chamber; and a coating with a reactive material present in the reaction chamber, wherein the reactive material is configured to, under influence of an electric arc, attenuate or extinguish the electric arc, wherein the reaction chamber is filled with an extinguishing agent which is a liquid medium; and, wherein the coating is substantially free of carbon-containing materials.

2. The interruption switch according to claim 1, wherein the reactive material is further configured to, under the influence of the electric arc, react to absorb energy from the electric arc.

3. The interruption switch according to claim 1, wherein the reactive material is further configured to, under the influence of the electric arc, be converted to non-conductive substances.

4. The interruption switch according to claim 1, wherein the reactive material is further configured to, under the influence of the electric arc, be vaporized.

5. The interruption switch according to claim 1, wherein the reactive material is further configured to, under the influence of the electric arc, be decomposed into reaction products configured to enter an exothermic reaction.

6. The interruption switch according to claim 1, wherein the reactive material comprises a ceramic material or glass.

7. The interruption switch according to claim 1, wherein the reactive material comprises a material based on $SiO_2$.

8. The interruption switch according to claim 1, wherein the contact unit comprises a sabot, or is connected to the sabot, the sabot configured to move from a starting position into an end position by exposure to pressure, wherein, in the end position of the sabot, the separation region is separated and an insulation spacing between the first connection contact and the second connection contact is achieved.

9. The interruption switch according to claim 8, wherein the contact unit comprises a surface directed towards the separation region which acts as the sabot, such that surface is moved from the starting position into the end position by exposure to pressure, wherein, in the end position of the sabot, the separation region is separated and the insulation spacing between the first connection contact and the second connection contact is achieved.

10. The interruption switch according to claim 1, wherein the extinguishing agent comprises a vaporizable agent.

11. A method comprising:

coating surfaces of a reaction chamber of an interruption switch with a reactive material, wherein the reactive material is configured to, under influence of an electric arc, react to attenuate or extinguish the electric arc, wherein the reaction chamber is filled with an extinguishing agent which is a liquid medium; and, wherein the reactive material is substantially free of carbon-containing materials.

12. The method according to claim 11, wherein the reactive material is applied to the surfaces as a liquid material and then dried.

13. The method according to claim 12, wherein the reactive material is a liquid ceramic or liquid glass.

* * * * *